US008341778B2

(12) United States Patent
Heimbrock

(10) Patent No.: US 8,341,778 B2
(45) Date of Patent: Jan. 1, 2013

(54) BED GAP FILLER AND FOOTBOARD PAD

(75) Inventor: Richard H. Heimbrock, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 13/355,775

(22) Filed: Jan. 23, 2012

(65) Prior Publication Data

US 2012/0198622 A1 Aug. 9, 2012

Related U.S. Application Data

(60) Provisional application No. 61/439,979, filed on Feb. 7, 2011.

(51) Int. Cl.
*A47C 21/08* (2006.01)

(52) U.S. Cl. ..... 5/600; 5/426

(58) Field of Classification Search ..... 5/424–430, 5/661, 663, 53.1
See application file for complete search history.

(56) References Cited

U.S. PATENT DOCUMENTS

| | | | |
|---|---|---|---|
| 421,656 | A | 2/1890 | Blanken |
| 993,119 | A | 5/1911 | Stannard |
| 1,008,168 | A | 11/1911 | Markus |
| 1,398,203 | A | 11/1921 | Schmidt |
| 1,682,394 | A | 8/1928 | Meutsch |
| 1,885,974 | A | 11/1932 | Winn |
| 2,136,088 | A | 11/1938 | Stevens |
| 2,164,484 | A | 7/1939 | Wolfe |
| 2,254,466 | A | 9/1941 | Albert |
| 2,281,209 | A | 4/1942 | Smith |
| 2,452,366 | A | 10/1948 | Freund |
| 2,556,591 | A | 6/1951 | Loxley |
| 2,564,083 | A | 8/1951 | Stechert |
| 2,564,084 | A | 9/1951 | Stechert |
| 2,587,291 | A | 2/1952 | Rochers |
| 2,605,151 | A | 7/1952 | Shampaine |
| 2,710,976 | A | 6/1955 | Martensen |
| 2,722,017 | A | 11/1955 | Burst et al. |
| 2,766,463 | A | 10/1956 | Bendersky |
| 2,817,854 | A | 12/1957 | Pratt |
| 2,817,855 | A | 12/1957 | Pratt |
| 2,979,738 | A | 7/1958 | Goldberg |
| 2,869,614 | A | 1/1959 | Wamsley |
| 2,951,252 | A | 9/1960 | Roche |

(Continued)

FOREIGN PATENT DOCUMENTS

DE 199 00 602 C 7/2000

(Continued)

*Primary Examiner* — Fredrick Conley
(74) *Attorney, Agent, or Firm* — Barnes & Thornburg LLP

(57) ABSTRACT

A hospital bed includes a frame having a head end, a foot end longitudinally spaced from the head end, and first and second laterally spaced sides. A siderail is coupled to the frame adjacent one of the first and second laterally spaced sides. A footboard is coupled to the frame adjacent the foot end such that a gap is defined between the siderail and the footboard. A barrier pad is coupleable to the frame in a first position and in a second position. The barrier pad is situated in the gap and extends generally longitudinally when coupled to the frame in the first position. The barrier pad extends generally laterally in juxtaposition with the footboard when coupled to the frame in the second position. The barrier pad, therefore, serves as a gap filler when in the first position and serves as a footboard pad in the second position.

20 Claims, 4 Drawing Sheets

U.S. PATENT DOCUMENTS

| | | | |
|---|---|---|---|
| 3,010,121 | A | 11/1961 | Breach |
| 3,018,492 | A | 1/1962 | Rosen |
| 3,021,534 | A | 2/1962 | Hausted |
| 3,048,857 | A | 8/1962 | Hutt |
| 3,053,568 | A | 9/1962 | Miller |
| 3,055,020 | A | 9/1962 | Mann |
| 3,097,370 | A | 7/1963 | Murcott |
| 3,099,440 | A | 7/1963 | Burzlaff |
| 3,112,500 | A | 12/1963 | MacDonald |
| 3,138,805 | A | 6/1964 | Piazza |
| 3,148,387 | A | 9/1964 | Sarnie et al. |
| 3,195,151 | A | 7/1965 | Boyer |
| 3,210,779 | A | 10/1965 | Herbold |
| 3,220,021 | A | 11/1965 | Nelson |
| 3,220,022 | A | 11/1965 | Nelson |
| 3,233,255 | A | 2/1966 | Propst |
| 3,239,853 | A | 3/1966 | MacDonald |
| 3,249,387 | A | 5/1966 | Pivacek |
| 3,256,533 | A | 6/1966 | Michelsen |
| 3,262,133 | A | 7/1966 | Beitzel |
| 3,266,545 | A | 8/1966 | Kruissink |
| 3,309,717 | A | 3/1967 | Black |
| 3,321,779 | A | 5/1967 | Kaufman et al. |
| 3,344,445 | A | 10/1967 | Crawford |
| 3,351,962 | A | 11/1967 | Dodrill et al. |
| 3,406,772 | A | 10/1968 | Ahrent et al. |
| 3,456,269 | A | 7/1969 | Goodman |
| 3,486,176 | A | 12/1969 | Murcott |
| 3,585,659 | A | 6/1971 | Burst et al. |
| 3,593,350 | A | 7/1971 | Knight et al. |
| 3,602,929 | A | 9/1971 | Murcott et al. |
| 3,610,685 | A | 10/1971 | Lay |
| 3,614,795 | A | 10/1971 | Agnew |
| 3,619,824 | A | 11/1971 | Doyle |
| 3,624,847 | A | 12/1971 | Murcott et al. |
| 3,640,566 | A | 2/1972 | Hodge |
| 3,735,432 | A | 5/1973 | Kreten et al. |
| 3,742,530 | A | 7/1973 | Clark |
| 3,823,428 | A | 7/1974 | Whyte |
| 3,845,511 | A | 11/1974 | Benoit et al. |
| 3,851,345 | A | 12/1974 | Benoit et al. |
| 3,865,434 | A | 2/1975 | Sully |
| 3,877,090 | A | 4/1975 | Schutz |
| 3,893,197 | A | 7/1975 | Ricke |
| 3,897,973 | A | 8/1975 | Long et al. |
| 3,905,591 | A | 9/1975 | Schorr et al. |
| 3,916,461 | A | 11/1975 | Kerstholt |
| 3,932,903 | A | 1/1976 | Adams et al. |
| 3,971,083 | A | 7/1976 | Peterson |
| 4,106,138 | A | 8/1978 | Murphy |
| 4,127,906 | A | 12/1978 | Zur |
| 4,139,917 | A | 2/1979 | Fenwick |
| 4,168,099 | A | 9/1979 | Jacobs et al. |
| 4,183,015 | A | 1/1980 | Drew et al. |
| 4,186,456 | A | 2/1980 | Huempfner |
| 4,214,326 | A | 7/1980 | Spann |
| 4,215,446 | A | 8/1980 | Mahoney |
| 4,232,415 | A | 11/1980 | Webber |
| 4,240,169 | A | 12/1980 | Roos |
| 4,258,445 | A | 3/1981 | Zur |
| 4,312,500 | A | 1/1982 | Janssen |
| 4,336,621 | A | 6/1982 | Schwartz et al. |
| 4,370,765 | A | 2/1983 | Webber |
| 4,409,695 | A | 10/1983 | Johnston et al. |
| 4,439,880 | A | 4/1984 | Koncelik et al. |
| 4,453,732 | A | 6/1984 | Assanah et al. |
| D276,112 | S | 10/1984 | Ferrell et al. |
| 4,484,367 | A | 11/1984 | Jenkins |
| 4,491,993 | A | 1/1985 | Santo |
| 4,557,471 | A | 12/1985 | Pazzini |
| 4,607,402 | A | 8/1986 | Pollard |
| 4,612,679 | A | 9/1986 | Mitchell |
| 4,653,129 | A | 3/1987 | Kuck et al. |
| 4,654,903 | A | 4/1987 | Chubb et al. |
| 4,670,923 | A | 6/1987 | Gabriel et al. |
| 4,672,698 | A | 6/1987 | Sands |
| 4,675,926 | A | 6/1987 | Lindblom et al. |
| 4,676,687 | A | 6/1987 | Koffler |
| 4,685,159 | A | 8/1987 | Oetiker |
| 4,704,750 | A | 11/1987 | Wheelock |
| 4,710,049 | A | 12/1987 | Chang |
| 4,710,992 | A | 12/1987 | Falwell et al. |
| 4,745,647 | A | 5/1988 | Goodwin |
| 4,747,171 | A | 5/1988 | Einsele et al. |
| 4,751,754 | A | 6/1988 | Bailey et al. |
| 4,757,564 | A | 7/1988 | Goodale |
| 4,767,419 | A | 8/1988 | Fattore |
| 4,768,249 | A | 9/1988 | Goodwin |
| 4,783,864 | A | 11/1988 | Turner |
| 4,799,277 | A | 1/1989 | Goodale |
| 4,800,600 | A | 1/1989 | Baum |
| 4,827,545 | A | 5/1989 | Arp |
| 4,839,933 | A | 6/1989 | Plewright et al. |
| 4,847,929 | A | 7/1989 | Pupovic |
| 4,858,260 | A | 8/1989 | Failor et al. |
| 4,862,529 | A | 9/1989 | Peck |
| 4,862,530 | A | 9/1989 | Chen |
| 4,872,228 | A | 10/1989 | Bishop |
| 4,873,734 | A | 10/1989 | Pollard |
| 4,894,876 | A | 1/1990 | Fenwick |
| 4,941,221 | A | 7/1990 | Kanzler |
| 4,944,055 | A | 7/1990 | Shainfeld |
| 4,974,905 | A | 12/1990 | Davis |
| 4,985,946 | A | 1/1991 | Foster et al. |
| 4,991,244 | A | 2/1991 | Walker |
| 4,993,089 | A | 2/1991 | Solomon et al. |
| 4,998,310 | A | 3/1991 | Olson |
| 5,010,611 | A | 4/1991 | Mallett |
| 5,035,014 | A | 7/1991 | Blanchard |
| 5,040,253 | A | 8/1991 | Cheng |
| 5,044,025 | A | 9/1991 | Hunsinger et al. |
| 5,060,327 | A | 10/1991 | Celestina et al. |
| 5,072,463 | A | 12/1991 | Willis |
| 5,077,843 | A | 1/1992 | Foster et al. |
| 5,083,332 | A | 1/1992 | Foster et al. |
| 5,083,334 | A | 1/1992 | Huck et al. |
| 5,084,925 | A | 2/1992 | Cook |
| 5,097,550 | A | 3/1992 | Marra, Jr. |
| 5,111,542 | A | 5/1992 | Farley |
| 5,129,117 | A | 7/1992 | Celestina et al. |
| 5,175,897 | A | 1/1993 | Marra, Jr. |
| 5,179,744 | A | 1/1993 | Foster et al. |
| 5,191,663 | A | 3/1993 | Holder et al. |
| 5,193,633 | A | 3/1993 | Ezenwa |
| 5,197,156 | A | 3/1993 | Stryker et al. |
| 5,205,004 | A | 4/1993 | Hayes et al. |
| D336,577 | S | 6/1993 | Celestina et al. |
| 5,216,768 | A | 6/1993 | Bodine et al. |
| 5,230,113 | A | 7/1993 | Foster et al. |
| 5,279,010 | A | 1/1994 | Ferrand et al. |
| 5,365,623 | A | 11/1994 | Springer |
| 5,381,571 | A | 1/1995 | Gabhart |
| 5,384,927 | A | 1/1995 | Mardero et al. |
| 5,408,710 | A | 4/1995 | Garman et al. |
| 5,410,765 | A | 5/1995 | Youngblood |
| 5,418,988 | A | 5/1995 | Iura |
| 5,421,046 | A | 6/1995 | Vande Streek |
| 5,450,641 | A | 9/1995 | Montgomery |
| 5,454,126 | A | 10/1995 | Foster et al. |
| 5,455,973 | A | 10/1995 | Brumfield et al. |
| 5,479,666 | A | 1/1996 | Foster et al. |
| 5,481,772 | A | 1/1996 | Glynn et al. |
| 5,485,699 | A | 1/1996 | Gabhart |
| 5,524,306 | A | 6/1996 | George |
| 5,530,974 | A | 7/1996 | Rains et al. |
| 5,537,699 | A | 7/1996 | Bonaddio et al. |
| 5,537,701 | A | 7/1996 | Elliott |
| 5,542,135 | A | 8/1996 | Ozrovitz et al. |
| 5,557,813 | A | 9/1996 | Steed et al. |
| 5,557,817 | A | 9/1996 | Haddock |
| 5,575,025 | A | 11/1996 | Peters |
| 5,577,277 | A | 11/1996 | Sundberg et al. |
| 5,577,279 | A | 11/1996 | Foster et al. |
| 5,636,397 | A | 6/1997 | Boyd et al. |
| 5,642,545 | A | 7/1997 | Howard |
| 5,642,546 | A | 7/1997 | Shoenhair |
| 5,671,490 | A | 9/1997 | Wu |

| | | | |
|---|---|---|---|
| 5,678,267 | A | 10/1997 | Kinder |
| 5,689,839 | A | 11/1997 | Laganiere et al. |
| 5,699,570 | A | 12/1997 | Wilkinson et al. |
| 5,701,623 | A | 12/1997 | May |
| 5,704,085 | A | 1/1998 | Sabalaskey |
| 5,715,548 | A | 2/1998 | Weismiller et al. |
| 5,732,423 | A | 3/1998 | Weismiller et al. |
| 5,745,937 | A | 5/1998 | Weismiller et al. |
| 5,745,939 | A | 5/1998 | Flick et al. |
| 5,749,112 | A | 5/1998 | Metzler |
| 5,761,756 | A | 6/1998 | Nowak et al. |
| 5,771,506 | A | 6/1998 | Joiner et al. |
| 5,781,945 | A | 7/1998 | Scherer et al. |
| 5,787,532 | A | 8/1998 | Langer et al. |
| 5,794,288 | A | 8/1998 | Soltani et al. |
| 5,802,636 | A | 9/1998 | Corbin et al. |
| 5,802,646 | A | 9/1998 | Stolpmann et al. |
| 5,832,549 | A | 11/1998 | Le Pallec et al. |
| 5,864,900 | A | 2/1999 | Landau |
| 5,878,452 | A | 3/1999 | Brooke et al. |
| 5,910,080 | A | 6/1999 | Selton |
| 5,926,873 | A | 7/1999 | Fountain |
| 5,956,787 | A | 9/1999 | James et al. |
| 5,960,497 | A | 10/1999 | Castellino et al. |
| 5,987,666 | A | 11/1999 | Zigmont |
| 6,038,721 | A | 3/2000 | Gordon |
| 6,058,531 | A | 5/2000 | Carroll |
| 6,081,950 | A | 7/2000 | Selton |
| 6,085,372 | A | 7/2000 | James et al. |
| 6,089,593 | A | 7/2000 | Hanson et al. |
| 6,223,369 | B1 | 5/2001 | Maier et al. |
| 6,223,370 | B1 | 5/2001 | Kluft |
| 6,249,924 | B1 | 6/2001 | Kluft |
| 6,256,822 | B1 | 7/2001 | Weston et al. |
| 6,289,539 | B1 | 9/2001 | Alpern |
| 6,347,422 | B2 | 2/2002 | Heavrin |
| 6,363,552 | B1 | 4/2002 | Hornbach et al. |
| 6,374,440 | B1 | 4/2002 | Thim, Jr. |
| 6,397,416 | B2 | 6/2002 | Brooke et al. |
| 6,401,277 | B1 | 6/2002 | Savage et al. |
| 6,401,281 | B1 | 6/2002 | Younge |
| 6,427,264 | B1 | 8/2002 | Metz et al. |
| 6,430,766 | B1 | 8/2002 | Henley et al. |
| 6,615,426 | B1 | 9/2003 | Risk, Jr. |
| 6,622,323 | B2 | 9/2003 | Zerhusen et al. |
| 6,629,326 | B2 | 10/2003 | Rabe |
| 6,640,360 | B2 | 11/2003 | Hornbach et al. |
| 6,668,399 | B2 | 12/2003 | Malstaff et al. |
| 6,704,954 | B2 | 3/2004 | Metz et al. |
| 6,721,975 | B1 | 4/2004 | Lemine |
| 6,820,293 | B2 | 11/2004 | Alverson |
| 6,874,179 | B2 | 4/2005 | Hensley et al. |
| 6,928,673 | B2 | 8/2005 | Risk, Jr. |
| 7,007,323 | B2 | 3/2006 | Zerhusen et al. |
| 7,107,636 | B2 | 9/2006 | Metz et al. |
| 7,237,284 | B2 | 7/2007 | Hensley et al. |
| 7,350,248 | B2 | 4/2008 | Hensley et al. |
| 7,934,276 | B2 | 5/2011 | Newkirk et al. |
| 2001/0044970 | A1 | 11/2001 | Heavrin |
| 2001/0054199 | A1 | 12/2001 | Zerhusen et al. |
| 2002/0095724 | A1 | 7/2002 | Hornbach et al. |
| 2002/0170113 | A1 | 11/2002 | Metz et al. |
| 2004/0000010 | A1 | 1/2004 | Zerhusen et al. |
| 2007/0180624 | A1* | 8/2007 | Newkirk et al. ..... 5/663 |
| 2009/0229050 | A1 | 9/2009 | Heimbrock |

FOREIGN PATENT DOCUMENTS

| | | |
|---|---|---|
| EP | 0037063 | 10/1981 |
| FR | 1450817 | 8/1966 |
| FR | 2680955 | 3/1993 |
| GB | 1466080 | 3/1977 |
| GB | 2163951 | 3/1986 |
| GB | 2229907 | 10/1990 |
| GB | 2267430 | 8/1993 |
| GB | 2284147 | 5/1995 |
| GB | 2313303 | 11/1997 |
| NL | 8300814 | 10/1981 |
| WO | 8101792 | 7/1981 |
| WO | 9817153 | 4/1998 |
| WO | 9915126 | 9/2008 |

* cited by examiner

BED GAP FILLER AND FOOTBOARD PAD

CROSS REFERENCE TO RELATED APPLICATIONS

The present application claims the benefit, under 35 U.S.C. §119(e), of U.S. Provisional Application No. 61/439,979 which was filed Feb. 7, 2011 and which is hereby incorporated by reference herein.

BACKGROUND

The present disclosure relates to gap fillers and footboard pads for beds used in hospitals and other patient care facilities such as nursing homes. More particularly, the present disclosure relates to gap fillers and footboard pads that are attachable to bed frames in different orientations.

Many beds used in hospitals have siderails, footboards, and headboards which server as barriers to prevent a patient from easily exiting the bed. The siderails are typically movable between respective raised positions, in which patient egress is blocked, and lowered positions, in which patient egress is permitted. It is sometimes desirable to add additional barriers in the spaces or gaps that may exist between the siderails of a bed and the associated headboard or footboard. These additional barriers are sometimes referred to as gap fillers.

During the care of some patients, it may be desirable to have the bottoms of the patient's feet supported against a generally vertical pad provided adjacent the footboard of the associated bed. Some hospital beds, such as the TotalCare bed and the VersaCare bed available from Hill-Rom Company, Inc., have extendable and retractable foot sections that can be adjusted in length. The length adjustment is accomplished by one or more actuators that are controlled by control circuitry of the bed in response to commands entered on user inputs of the bed. Thus, in such beds, the foot section can be retracted from its most extended position to move the footboard toward the patient's feet and then, eventually, into contact with the bottoms of the patient's feet for patients having a wide variety of heights. It is not uncommon to place a pad between the patient's feet and the footboard in these instances.

SUMMARY

A gap filler and/or a footboard pad for a patient bed, or a patient bed having such a gap filler and/or footboard, has one or more of the features recited in the appended claims and/or the following features which, alone or in any combination, may comprise patentable subject matter:

A hospital bed may include a frame having a head end and a foot end longitudinally spaced from the head end. The frame may also have first and second laterally spaced sides. A siderail may be coupled to the frame adjacent one of the first and second laterally spaced sides. A footboard may be coupled to the frame adjacent the foot end such that a gap may be defined between the siderail and the footboard.

A barrier pad may be coupleable to the frame in a first position and in a second position. The barrier pad may be situated in the gap and may extend generally longitudinally when coupled to the frame in the first position. The barrier pad may extend generally laterally in juxtaposition with the footboard when coupled to the frame in the second position. The barrier pad, therefore, may serve as a gap filler when in the first position and may serve as a footboard pad in the second position.

In some embodiments, the barrier pad may include a main body and first and second posts extending downwardly from the main body. The frame may include first, second and third post receivers. The first post of the barrier pad may be received in the second post receiver when the barrier pad is in the first position and when the barrier pad is in the second position. However, the second post may be received in the first post receiver when the barrier pad is in the first position and the second post may be received in the third post receiver when the barrier pad is in the second position. Thus, one of the posts of the barrier pad is received in the same post receiver regardless of whether the barrier pad is in the first position or the second position. The other of the posts is received by one of the other two remaining post receivers depending upon whether the barrier pad is in the first or second position.

In some embodiments, the main body of the barrier pad is generally upside down L-shaped. For example, the barrier pad may comprise an upstanding rectangular portion and a substantially square shaped portion that extends from an upper region of the upstanding rectangular portion in a cantilevered manner. The barrier pad may include a coupler that may extend from a bottom of the upstanding rectangular portion and that may be configured to couple the barrier pad to the frame. The coupler may comprise the first and second posts.

The barrier pad may further comprise a substantially rigid frame situated internally of the main body. The main body inherently has a height and the substantially rigid frame may be coupled to the first and second posts and may be configured to extend upwardly from the posts to about half way up the height of the main body. According to this disclosure, the main body may comprise foam material that may be encased in a ticking.

The footboard may include a laterally extending mid-region and outer side regions that are angled with respect to the mid-region. The barrier pad may flex to substantially match the contour of a portion of the mid-region and one of the side regions when the barrier pad is in the second position. Thus, the barrier pad is in an unflexed state when in the first position and is in a flexed state when in the second position.

The siderail may be movable relative to the frame between a raised position to inhibit the patient from egressing from the frame and a lowered position to permit the patient to egress from the frame. The barrier pad may have a first top surface that may be substantially coplanar with a second top surface of the siderail when the siderail is in the raised position and the barrier pad is in the first position.

The frame may include a mattress support deck having a set of movable deck sections including a foot section. The barrier pad may couple to the foot section when the barrier pad is in the first position and when the barrier pad is in the second position. Thus, the barrier pad moves with the foot section as the foot section moves relative to the remainder of the frame, such as by articulating relative to an adjacent thigh section. The barrier pad may include at least one first coupler and the foot section may include at least one second coupler that interfaces with the first coupler to couple the barrier pad to the frame. The at least one first coupler may comprise, for example, a pair of posts and the at least one second coupler may comprise a series of post receivers that receive the posts.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures, in which.

DETAILED DESCRIPTION

Figure 1:
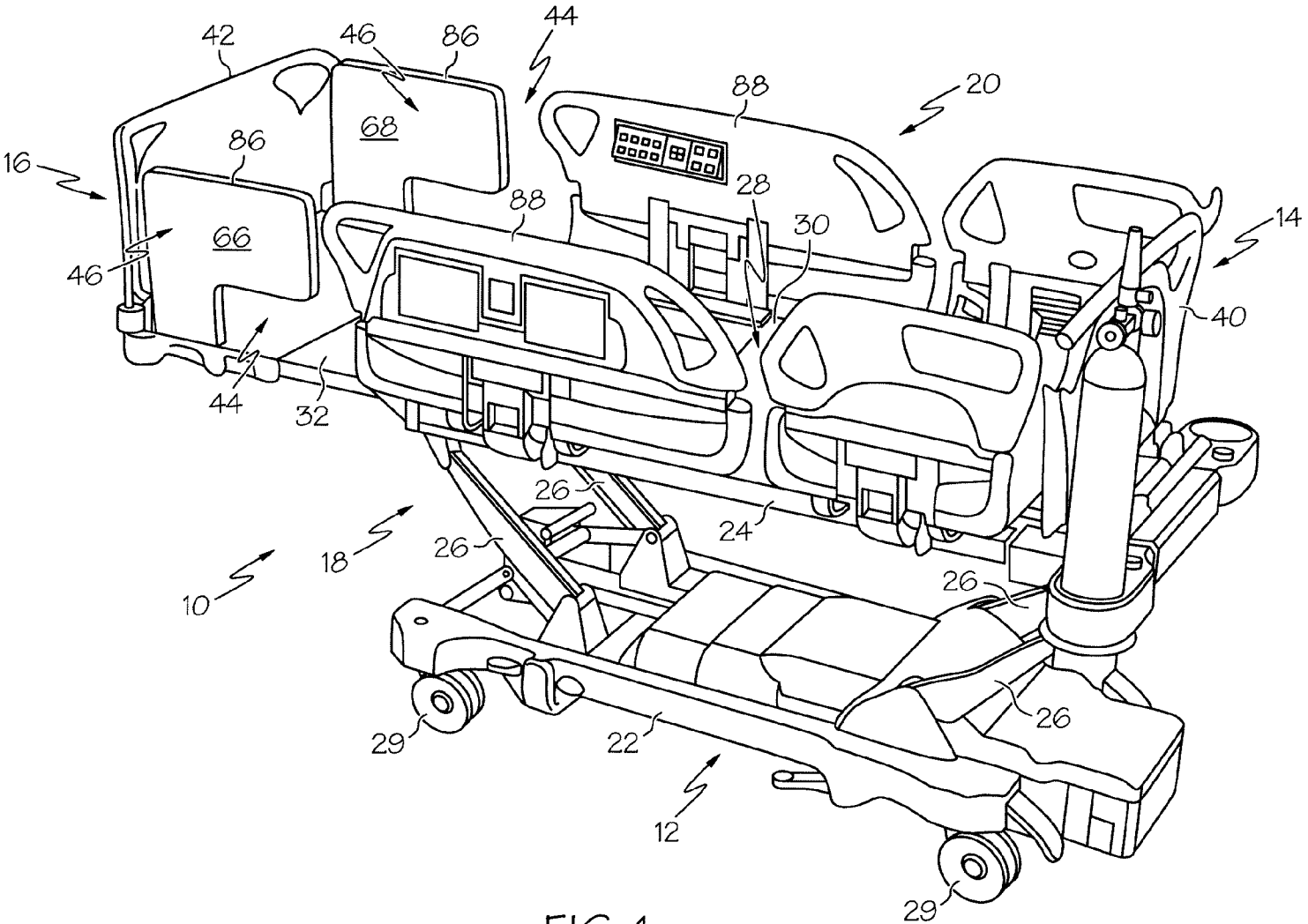
FIG. 1 is a perspective view of a hospital bed showing a pair of barrier pads each in a first position coupled to a foot section of a mattress support deck of a frame of the hospital bed so that the barrier pads fill a substantial amount of a pair of gaps defined between a footboard and a pair of siderails of the hospital bed.
Figure 2:
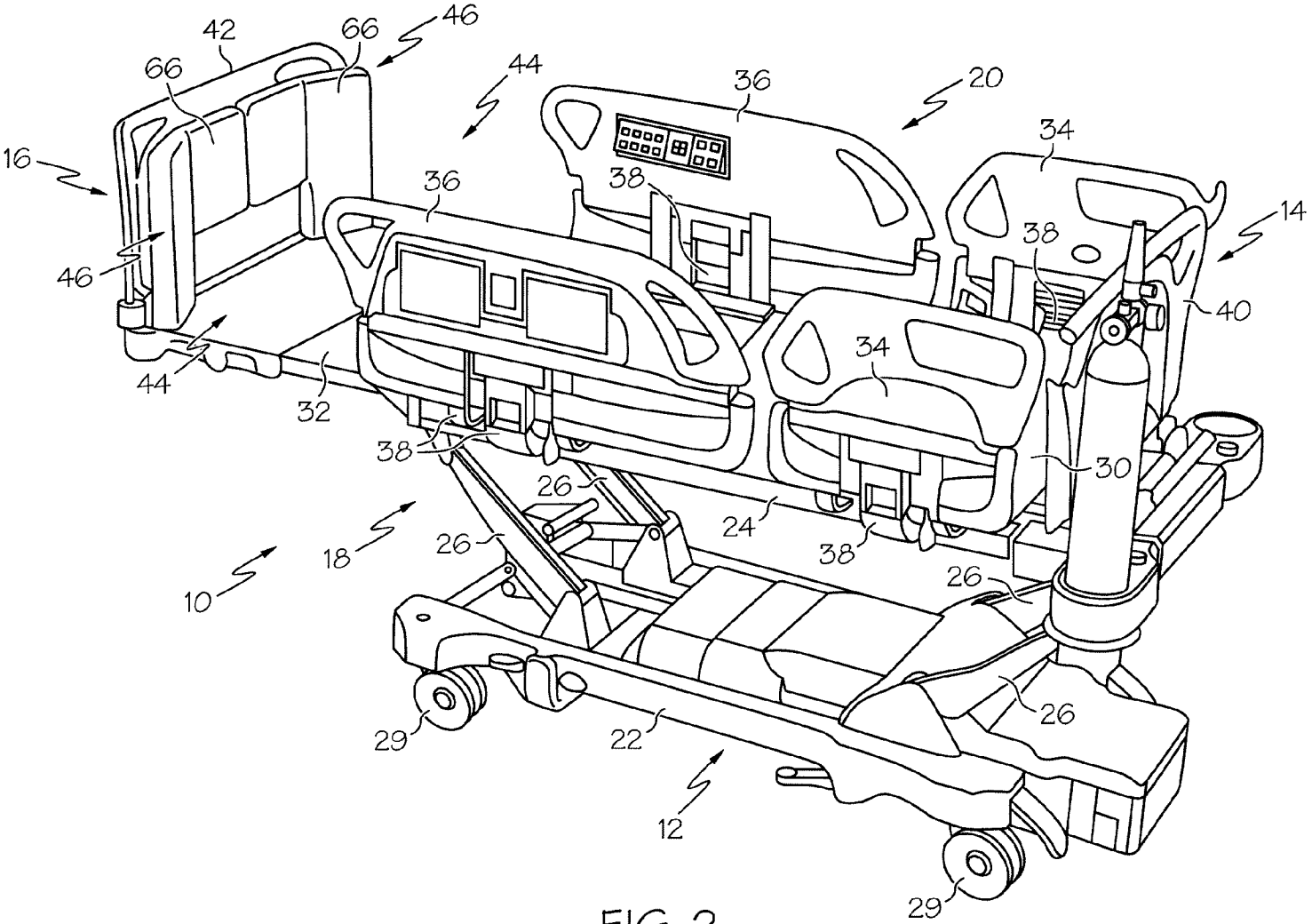
FIG. 2 is a perspective view of the hospital bed, similar to FIG. 1, with the pair of barrier pads each in a second position coupled to the foot section in juxtaposition with the footboard so that the barrier pads are able to serve as footboard pads for engagement with bottoms of a patient's feet.

A hospital bed 10 includes a frame 12 having a head end 14 and a foot end 16 longitudinally spaced from the head end as shown in FIGS. 1 and 2. Frame 12 also has first and second laterally spaced sides 18, 20. Frame 12 includes a base 22, an upper frame 24, and a set of lift arms 26 that are moveable to raise, lower, and tilt upper frame 24 relative to base 24. Frame 12 further includes a mattress support deck 28 which includes a head section 30 and a foot section 32. Deck 28 also includes a seat section and/or thigh section (not shown) situated between sections 30, 32 as is known in the art. Bed 10 includes a number of actuators (not shown), such as linear actuators with electric motors, that articulate at least some of the sections of deck 28 relative to upper frame 24 and that act on the lift arms 26. A set of four casters 29, only two of which can be seen in FIGS. 1 and 2, are coupled to base 22 and support bed 10 relative to an underlying floor (not shown).

Bed 10 includes a pair of head end siderails 34 coupled to head section 30 and a pair of foot end siderails 36 coupled to upper frame 24. Thus, siderails 34, 36 are situated adjacent respective lateral sides 18, 20 of frame 12. A linkage mechanism 38 is provided with each of siderails 34, 36 to control movement of siderails 34, 36 between respective raised and lowered positions. When in the raised positions, the siderails 34, 36 inhibit the patient from egressing from a mattress (not shown) supported atop deck 28 and, when the siderails 34, 36 are in the lowered positions, they are out of the way to permit the patient to egress from the mattress. Bed 10 also includes a headboard 40 coupled to head end 14 of upper frame 24 and a footboard 42 coupled to a foot end 16 of foot section 32. When siderails 36 are in the respective raised positions, a gap 44 is defined between each siderail 36 and footboard 42.

Bed 10 includes a pair of barrier pads 46, each of which is coupleable to foot section 32 of frame 12 in a first position, as shown in FIG. 1, and in a second position, as shown in FIG. 2. When barrier pads 46 are coupled to foot section 32 in the first position, they are situated in respective gaps 44 and extend generally longitudinally with respect to bed 10. Barrier pads 46 are sized to fill a substantial portion, such as more than half, of each of the respective gaps 44 when in the first position as is evident in FIG. 1. When barrier pads 46 are coupled to foot section 32 in the second position, they extend generally laterally in juxtaposition with the footboard 42 as shown in FIG. 2. Thus, the barrier pads 46 serve as a gap filler when in the first position and serve as a footboard pad in the second position.

Figure 3:
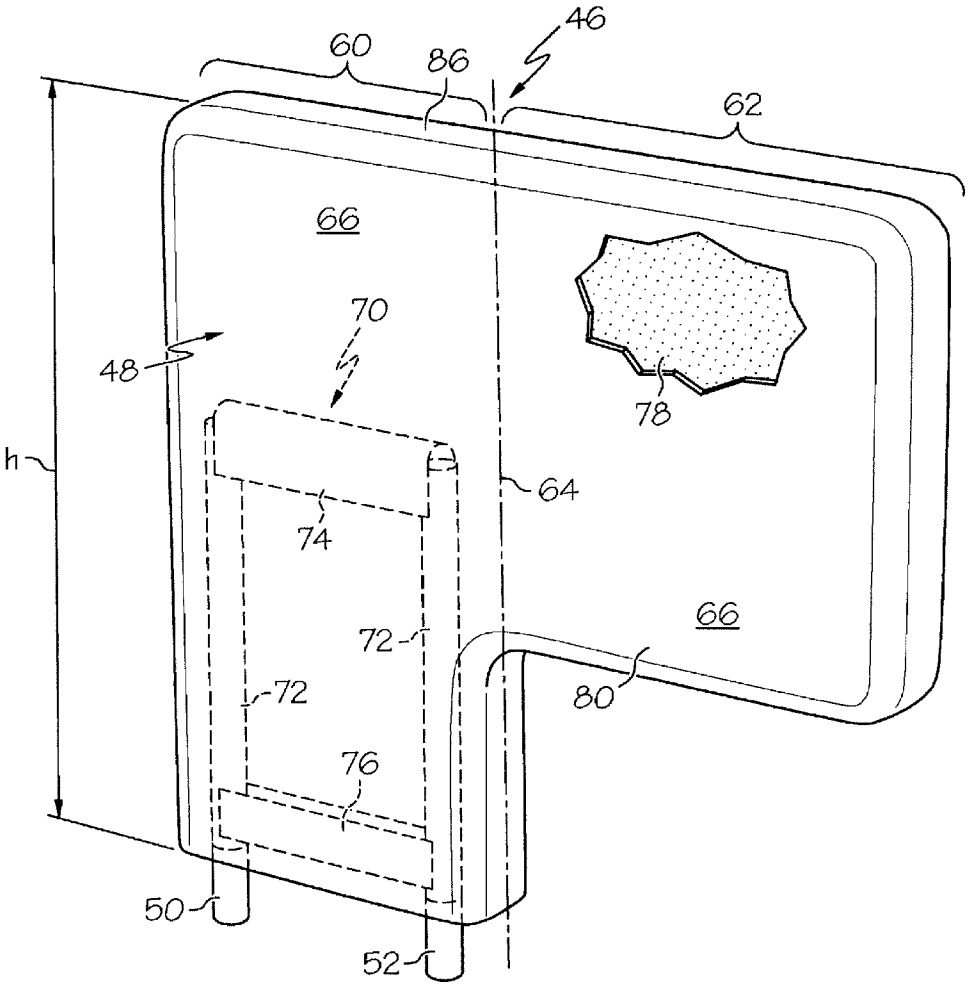
FIG. 3 is an enlarged perspective view of one of the barrier pads showing the barrier pad having an upside L-shaped main body, a pair of posts extending downwardly from the main body, and a substantially rigid frame situated inside the main body and coupled to the pair of posts.
Figure 4:
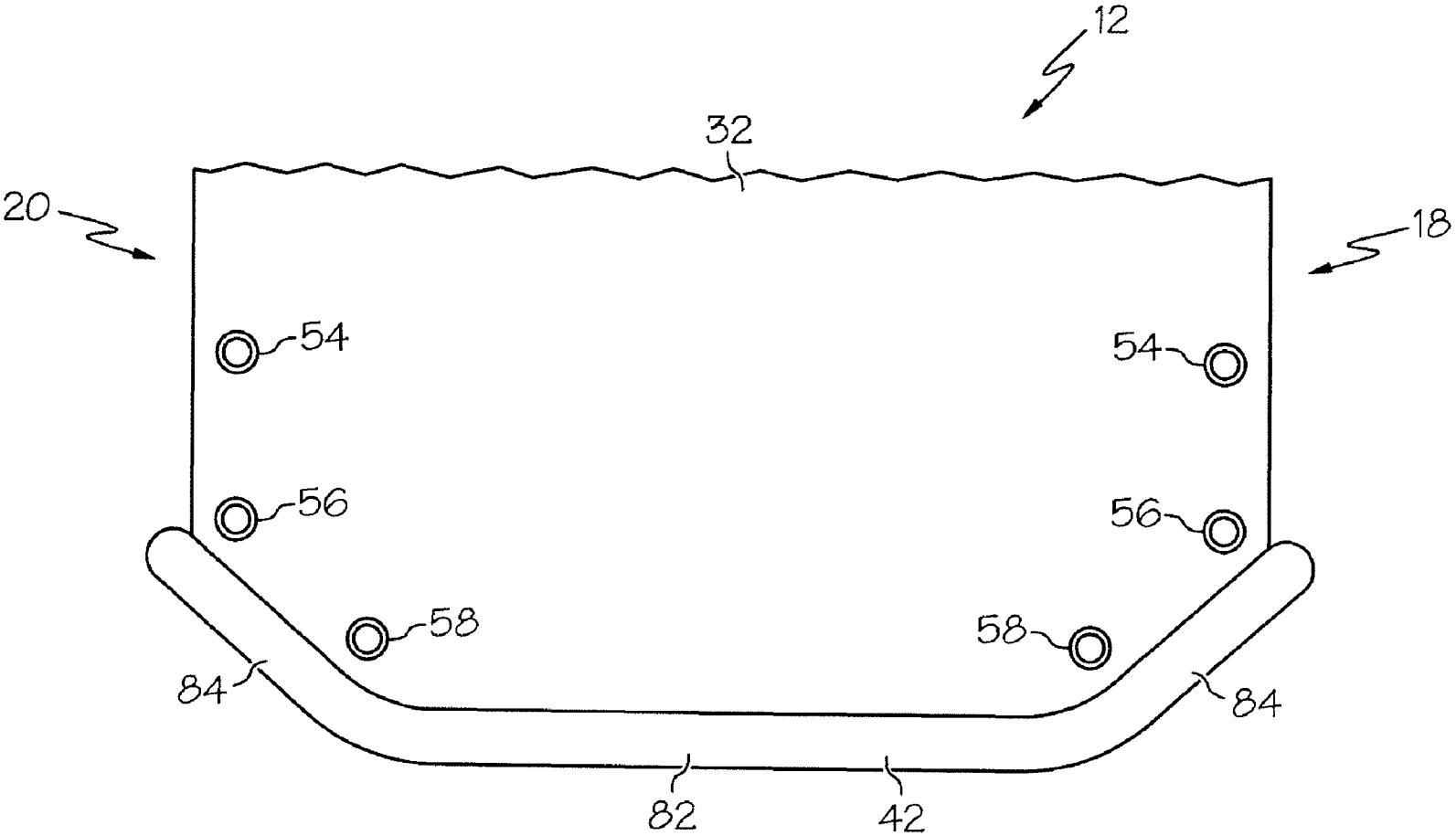
FIG. 4 is a top view of a portion of the hospital bed showing the foot section having a set of three post receivers on each side of the foot section near the footboard of the hospital bed.

Referring now to FIG. 3, one of barrier pads 46 will be described in more detail. However, both of barrier pads 46 are constructed similarly and so the discussion of one of barrier pads 46 is equally applicable to both. Barrier pad 46 includes a main body 48 and couplers, such as illustrative first and second posts 50, 52 extending downwardly from the main body 48. As shown in FIG. 4, foot section 32 of frame 12 includes first, second and third post receivers 54, 56, 58. Post receivers 54, 56, 58 comprise holes or sockets, for example. The first post 50 of the barrier pad 46 is received in the second post receiver 56 when the barrier pad 46 is in the first position and when the barrier pad 46 is in the second position. However, the second post 52 is received in the first post receiver 54 when the barrier pad 46 is in the first position and the second post 52 is received in the third post receiver 58 when the barrier pad 46 is in the second position. Thus, first post 50 of the barrier pad 46 is received in the same post receiver 56 regardless of whether the barrier pad 46 is in the first position or the second position. The second post 52 is received by one of the other two remaining post receivers 54, 58 depending upon whether the barrier pad 46 is in the first or second position. To move barrier pad 46 between the first and second positions, barrier pad 46 is lifted upwardly relative to foot section 32 so that posts 50, 52 are withdrawn from whichever of post receivers 54, 56, 58 were previously occupied, thereby allowing barrier pad 46 to be re-oriented in the desired position so that posts 50, 52 are aligned with the appropriate post receivers 54, 56, 58, and then barrier pad 46 is lowered downwardly relative to foot section 32 to insert posts 50, 52 into the appropriate post receivers 54, 56, 58.

The main body 48 of the barrier pad 46 is generally upside down L-shaped as shown in FIG. 3. The illustrative barrier pad 46 includes an upstanding rectangular portion 60 and a substantially square shaped portion 62 that extends from an upper region of the upstanding rectangular portion 60 in a cantilevered manner. A phantom line 64 is provided in FIG. 3 to illustrate the imaginary demarcation or boundary between portions 60, 62 of barrier pad 46. Each barrier pad 46 includes a first side or face 66 and a parallel opposite second side or face 68 as shown best in FIG. 1. When barrier pads 46 are in the first positions, the first faces 66 face generally outwardly away from deck 28 and the second faces 68 face generally inwardly toward deck 28 as shown in FIG. 1. When barrier pads 46 are in the second positions, the first faces 66 face generally forwardly toward deck 28 and the second faces 68 face generally rearwardly toward foot board 42 as shown in FIG. 2.

Referring once again to FIG. 3, the barrier pad 46 further includes a substantially rigid frame 70 situated internally of the main body 48. In particular, frame 70 is situated in the lower part of the upstanding rectangular portion 60 of barrier pad 46. The main body 48 has a height h and the substantially rigid frame 70 extends upwardly from the posts 50, 52 to about half way up the height h of the main body 48. In the illustrative example, frame 70 extends upwardly from posts 50, 52 by slightly more than half of height h. Height h is between about 12 to about 18 inches in some embodiments. The thickness of barrier pad 46 between faces 66, 68 is between about 1 to about 3 inches in some embodiments.

Frame 70 is made up of vertical extensions 72 of each of posts 50, 52 and first and second horizontal frame members 74, 76 that interconnect extensions 72. Frame members 74, 76 are U-shaped channel members in the illustrative embodiment. Frame member 74 interconnects the upper regions of extensions 72 and frame member 76 interconnects the lower regions of extensions 72. The main body 48 of barrier pad 46 also includes foam material 78 encased in a ticking 80. Thus, main body 48 includes a soft foam material 78 that is molded around frame 70 in some embodiments. For example, the soft foam material 78 comprises a self-skinning urethane foam in some embodiments.

The footboard 42 includes a laterally extending mid-region 82 and outer side regions 84 that are angled with respect to the mid-region 82 as shown in FIG. 4. The barrier pad 46 flexes to substantially match the contour of a portion of the mid-region 82 and one of the side regions 84 when the barrier pad 46 is in the second position. The line along which barrier pad 46 flexes when in the second position adjacent footboard 42 is phantom line 64, shown in FIG. 3, that demarcates the boundary between portions 60, 62 of barrier pad 46. Thus, the barrier pad 46 is in an unflexed state when in the first position and is in a flexed state when in the second position.

Each of the barrier pads 46 has a first top surface 86 that is substantially coplanar with a second top surface 88 of each of the respective siderails 36 when the siderails 36 is in the raised position, the barrier pads 46 are in the respective first positions and the foot section 32 and upper frame 24 are horizontal as shown in FIG. 1. In the illustrative example, foot section 32 of bed 10 is extendable and retractable. Thus, barrier pads 46 move with the portion of foot section 32 that extends and retracts. When the foot section 32 is retracted by a sufficient amount with barrier pads 46 in the respective first positions, the head end regions of portions 62 of barrier pads 46 move to positions just inside the foot end regions of siderails 36. Thus, barrier pads 46 are offset from siderails to permit the overlapping between siderails 36 and barrier pads 46 to occur when foot section 32 is retracted.

Thus, based on the foregoing, it will be appreciated that each barrier pad 46 has a metal frame 70 and posts 50, 52 that plug into two holes 54, 56 that are parallel to sides 18, 20 of the foot section 32 of bed 10 when the barrier pads are in the first positions, and that plug into two holes 56, 58 to position the barrier pads 46 next to the footboard 42 when the barrier pads are in the second positions. The metal frame 70 of each barrier pad 46 is surrounded by foam 78 and an outer ticking 80 that facilitates cleaning of the respective barrier pad 46. The frame 70 only comes approximately half way up inside the foam 78 and only at the foot end 16 of the foam 78. This permits the barrier pads 46 to flex to contour with the footboard 42 and also to bend if someone grabs either of the barrier pads 46 to try to move the bed 10 with it. When in the first positions, the barrier pads 46 keep the patient's feet from falling off of the sides 18, 20 of the bed 10 and also provide a visual barrier to someone wanting to escape out of the side of the bed 10. When in the second positions, the barrier pads 46 provide a soft surface next to the footboard 42 for engaging the bottoms of the patient's feet which helps to prevent skin breakdown on the bottom of the patient's feet that might otherwise occur if the patient's feet were engaged directly by footboard 42.

Although certain illustrative embodiments have been described in detail above, many embodiments, variations and modifications are possible that are still within the scope and spirit of this disclosure as described herein and as defined in the following claims.

The invention claimed is:

1. A hospital bed comprising a frame having a head end and a foot end longitudinally spaced from the head end, the frame having a first and second laterally spaced sides, a siderail coupled to the frame adjacent one of the first and second laterally spaced sides, a footboard coupled to the frame adjacent the foot end, a gap being defined between the siderail and the footboard, and a barrier pad that is coupleable to the frame in a first position and in a second position, the barrier pad being situated in the gap and extending generally longitudinally when coupled to the frame in the first position, the barrier pad extending generally laterally in juxtaposition with the footboard when coupled to the frame in the second position, wherein the frame includes a mattress support deck having a set of movable deck sections including a foot section and wherein the barrier pad couples to the foot section when the barrier pad is in the first position and when the barrier pad is in the second position wherein the barrier pad includes at least one first coupler and the foot section includes at least one second coupler that interfaces with the first coupler to couple the barrier pad to the frame, wherein the at least one first coupler comprises a pair of posts and the at least one second coupler comprises a series of post receivers that receive the posts.

2. A hospital bed comprising a frame having a head end and a foot end longitudinally spaced from the head end, the frame having a first and second laterally spaced sides, a siderail coupled to the frame adjacent one of the first and second laterally spaced sides, a footboard coupled to the frame adjacent the foot end, a gap being defined between the siderail and the footboard, and a barrier pad that is coupleable to the frame in a first position and in a second position, the barrier pad being situated in the gap and extending generally longitudinally when coupled to the frame in the first position, the barrier pad extending generally laterally in juxtaposition with the footboard when coupled to the frame in the second position, wherein the barrier pad includes a main body and first and second posts extending downwardly from the main body.

3. The hospital bed of claim 2, wherein the frame includes first, second and third post receivers, the first post of the barrier pad is received in the second post receiver when the barrier pad is in the first position and when the barrier pad is in the second position.

4. The hospital bed of claim 3, wherein the second post is received in the first post receiver when the barrier pad is in the first position and the second post is received in the third post receiver when the barrier pad is in the second position.

5. The hospital bed of claim 2, wherein the main body of the barrier pad is generally upside down L-shaped.

6. The hospital bed of claim 2, wherein the barrier pad further comprises a substantially rigid frame situated internally of the main body.

7. The hospital bed of claim 6, wherein the main body has a height and the substantially rigid frame is coupled to the first and second posts and extends upwardly from the posts to about half way up the height of the main body.

8. The hospital bed of claim 2, wherein the main body comprises foam material encased in a ticking.

9. The hospital bed of claim 2, wherein the footboard includes a laterally extending mid-region and outer side regions that are angled with respect to the mid-region and wherein the barrier pad flexes to substantially match the contour of a portion of the mid-region and one of the side regions when the barrier pad is in the second position.

10. The hospital bed of claim 2, wherein the siderail is movable relative to the frame between a raised position to inhibit the patient from egressing from the frame and a lowered position to permit the patient to egress from the frame and wherein the barrier pad has a first top surface that is substantially coplanar with a second top surface of the siderail when the siderail is in the raised position and the barrier pad is in the first position.

11. The hospital bed of claim 2, wherein the frame includes a mattress support deck having a set of movable deck sections including a foot section and wherein the barrier pad couples to the foot section when the barrier pad is in the first position and when the barrier pad is in the second position.

12. The hospital bed of claim 11, wherein the barrier pad includes at least one first coupler and the foot section includes at least one second coupler that interfaces with the first coupler to couple the barrier pad to the frame.

13. The hospital bed of claim 2, wherein the barrier pad comprises an upstanding rectangular portion and a substantially square shaped portion extending from an upper region of the upstanding rectangular portion in a cantilevered manner.

14. The hospital bed of claim 13, wherein at least one of the first and second posts extends from a bottom of the upstanding rectangular portion.

15. A hospital bed comprising a frame having a head end and a foot end longitudinally spaced from the head end, the frame having a first and second laterally spaced sides, a siderail coupled to the frame adjacent one of the first and second laterally spaced sides, a footboard coupled to the frame adjacent the foot end, a gap being defined between the siderail and the footboard, and a barrier pad that is coupleable to the frame in a first position and in a second position, the barrier pad being situated in the gap and extending generally longitudinally when coupled to the frame in the first position, the barrier pad extending generally laterally in juxtaposition with the footboard when coupled to the frame in the second position, wherein the barrier pad includes a main body and spaced apart first and second couplers situated at a bottom of the main body.

16. The hospital bed of claim 15, wherein the main body of the barrier pad is substantially straight when in the first position and is bent when in the second position.

17. The hospital bed of claim 15, wherein the frame includes first, second and third connectors, the first coupler of the barrier pad is coupled to the second connector when the barrier pad is in the first position and when the barrier pad is in the second position.

18. The hospital bed of claim 17, wherein the second coupler is coupled to the first connector when the barrier pad is in the first position and the second coupler is coupled to the third connector when the barrier pad is in the second position.

19. The hospital bed of claim 15, wherein the main body of the barrier pad is generally upside down L-shaped.

20. The hospital bed of claim 15, wherein the first coupler comprises a first post and the second coupler comprises a second post.

* * * * *